US006006578A

United States Patent [19]

Reitter

[11] Patent Number: 6,006,578

[45] Date of Patent: Dec. 28, 1999

[54] DIE FOR DRAWING MOLDED SHEET METAL PARTS

[76] Inventor: Erhardt Reitter, Am Rosenhag 1, D-75056 Sulzfeld, Germany

[21] Appl. No.: 09/008,032

[22] Filed: Jan. 16, 1998

[30] Foreign Application Priority Data

Jan. 25, 1997 [DE] Germany ..... 197 02 636

[51] Int. Cl.[6] ..... B21D 24/08

[52] U.S. Cl. ..... 72/351

[58] Field of Search ..... 72/350, 351

[56] References Cited

U.S. PATENT DOCUMENTS 1,970,134 8/1934 Ferris ..... 72/358

5,138,857 8/1992 Siegert ..... 72/351

FOREIGN PATENT DOCUMENTS 30 22 844 1/1982 Germany .

33 33 687 3/1985 Germany .

*Primary Examiner*—Lowell A. Larson

*Attorney, Agent, or Firm*—Collard & Roe, P.C.

[57] ABSTRACT

A die for drawing molded sheet metal parts has a bottom part of the die and a top part of the die. These parts are movably guided toward each other. One of these parts has a draw ring. The other part of the die has a sheet metal holder received on a plurality of hydraulically operating cylinders. There is a draw punch, which is enclosed by the sheet metal holder and is supported on at least one hydraulically operating cylinder. The punch is communicatively connected with at least one of the operating cylinders serving for the support of the sheet metal holder. The punch is acted upon by a hydraulic fluid displaced from this operating cylinder during the drawing process. Thus, the draw punch will move in the direction opposite to the movement of the sheet metal holder.

5 Claims, 1 Drawing Sheet

DIE FOR DRAWING MOLDED SHEET METAL PARTS

BACKGROUND OF THE INVENTION

1. Field of the Invention

The present invention relates to a die for drawing molded sheet metal parts, with the die having a bottom part and a top part.

These die parts are movably guided toward each other. One of these die parts has a draw ring. The other part of the die has a sheet metal holder received on a plurality of hydraulically operating cylinders. There is a draw punch, which is adjacent to the sheet metal holder and is supported on at least one hydraulically operating cylinder. The draw punch is communicatively connected with at least one of the operating cylinders serving for the support of the sheet metal holder. The draw punch is acted upon by a hydraulic fluid displaced from this operating cylinder during the drawing process. Thus, the draw punch will move in the direction opposing the movement of the sheet metal holder.

2. The Prior Art

German Patent DE 3,022,844 A1 describes a die which can drive a draw punch in the opposite direction of a draw ring which depends on the downward movement of the draw ring. Thus, it is possible to realize complicated counter draw steps relative to the main drawing process. It is also possible to break up the drawing process into a series of partial drawing steps. The partial drawing steps occur in such a way that part of the drawing depth is achieved through the movement of a draw ring which is lowered by the ram of the drawing press. Another part of the drawing occurs through a movement of the draw punch in the opposite direction.

In this prior art die, as a draw ring is directly actuated by a press ram and is being lowered, there is a pressure medium flowing off from at least one of the pressure cylinders. The pressure cylinder provides support for the sheet metal holder. The pressure medium flows by way of suitable flow paths or conduits into at least one of the pressure cylinders supporting the draw punch, and acts upon the piston guided in the pressure cylinder. This thereby drives the draw punch in the direction opposite to the movement of the draw ring. Another advantage of the known die is that the pressure energy of the pressure medium displaced from the pressure cylinders will support the sheet metal holder as the draw ring is being lowered. The energy resulting from the downward travel of this draw ring is used for driving a draw punch in a direction opposite to the movement of the draw ring.

A problem that keeps recurring during the drawing of molded sheet metal parts with such dies is that the highly undesirable formation of wrinkles and folds may occur in critical drawing areas. These wrinkles can sometimes be eliminated later with difficulty by costly after-treatment of the drawn parts. Sometimes the wrinkles cannot be eliminated. Particularly critical are those drawing areas where the edge of the workpiece is gripped between a sheet metal holder and a draw ring and vibrations occur during the drawing operation. This is the case where wrinkles occur, for example at the corners of sinks having a rectangular cross section.

With these prior art dies, the sheet metal holder always has a sheet metal holder plate, which is received on head plate. The draw ring is normally mounted on a carrier plate. It is known that with such dies that folds potentially developing during the drawing process are avoided by partly increasing within the critical drawing areas the holding force which grips the sheet metal.

It is possible to increase the holding force retaining the sheet metal by placing draw pins underneath the critical areas and to press against sections of the die plates disposed adjacent to such critical areas. It is known also to insert in areas where the formation of folds occurs, strips of paper or sheet metal between the head plate and the sheet metal holder. These strips can be inserted also between the carrier plate and the draw ring.

Pressing against the die plates in the zones disposed adjacent to critical areas does in fact lead to satisfactory results. However, this step is extremely time-consuming and consequently expensive. On the other hand, placing draw pins underneath the critical areas does not always produce the desired results. This is especially true since it is difficult to precisely determine the dimension of such intermediate layers required for eliminating the formations of wrinkles and folds. This applies also to the installation of strips of paper or sheet metal between a sheet metal holder plate and/or a draw ring, on the one hand, and the corresponding parts of the die on the other hand.

Furthermore, this corrective action was found to be extremely time-consuming and costly. This is because the sheet metal holder plate and/or the draw ring have to be removed before such strips of paper or sheet metal can be placed in position. The strip of paper or sheet metal then has to be pushed into the gap between the involved part of the die and the draw ring or sheet metal holder plate. Then the draw ring or the sheet metal holder plate subsequently have to be moved into the correct position again.

SUMMARY OF THE INVENTION

It is an object of the present invention to provide a die for drawing sheet metal parts, where a partial increase in the force for retaining the sheet metal during the drawing process is accomplished by adjusting the sheet metal holder plate. This makes it possible to prevent the undesirable formation of the formation of wrinkles or folds in a simple way.

This object is achieved by the drawing die of the invention, in which the sheet metal holder is partly supportable on pistons. These pistons are acted upon by a hydraulic fluid from the admission chambers of the operating cylinders on which the sheet metal holder is supported.

Thus, in order to incrementally increase the force holding and retaining the sheet metal, the sheet metal holder is received on the hydraulically operating cylinders and is supported in sections on the pistons adjacent to the cylinders. These pistons are acted upon by hydraulic fluid from the fluid admission chambers of the operating cylinders. Consequently, the sheet metal holder is subjected to limited elastic deformation by the action of the drawing force. Also the sheet metal retaining force occurring in the areas supported by these pistons is incrementally higher than the force in the other areas of the sheet metal holder. With the pistons arranged to partly supporting the sheet metal holder and acted upon by hydraulic fluid from the fluid admission chambers of the operating cylinders receiving the sheet metal holder, the formation of wrinkles during the drawing process is preventable.

In a further embodiment, the pistons are acted upon by hydraulic fluid from the fluid admission chambers of the operating cylinders. These cylinders receive the sheet metal holder and partially support the holder via selectively engageable pressure pieces. By engaging or disengaging such pressure pieces, it is possible to activate or deactivate the pistons acted upon by the hydraulic fluid from the fluid admission chambers of the working cylinders. This makes it possible to control the sheet metal retaining forces occurring in the drawing process.

In another embodiment, the operating cylinders for receiving and supporting the sheet metal holder are arranged in a cylinder plate. The operating pistons are guided in the operating cylinders and project from a die base plate into the operating cylinders. The die base plate is receivable on the table of a drawing press. On the side facing away from the base plate, at least some of the operating cylinders are equipped with auxiliary pistons for partly supporting the sheet metal holder. These auxiliary pistons are received in bores and are acted upon by hydraulic fluid from the fluid admission chambers of the operating cylinders.

In a further embodiment, the operating cylinders on which the sheet metal holder is received and supported extend from the underside of the holder into the base plate. The auxiliary pistons partly supporting the sheet metal holder are received in bores. These bores extend from the bottom of the operating cylinders facing away from the die base plate through the cylinder plate. Accordingly, the auxiliary pistons which partly support the sheet metal holder are acted upon by hydraulic fluid from the fluid admission chambers of the operating cylinders which are supporting the sheet metal holder. The auxiliary pistons of the operating cylinders which provide the partial support of the sheet metal holder are constructed as follows. When the auxiliary pistons are fully extended, they are disposed below the surface of the cylinder plate facing away from the base plate. Here the auxiliary pistons engage the sheet metal holder via selectively engaged pressure pieces. Also, in their fully extended position, the auxiliary pistons of the operating cylinders partly supporting the sheet metal holder may also project beyond the cylinder plate.

In another embodiment, a perforated plate is received on the cylinder plate having the operating cylinders. This perforated plate is provided with through-extending bores arranged coaxially with the auxiliary pistons acted upon by hydraulic fluid from the pressure fluid admission chambers of the operating cylinders. Spacer bolts serving as movable pressure pieces are guided in at least some of the through-extending bores. The spacer bolts are adjacent to the auxiliary pistons, and project beyond the cylinder plate and the receiving parts of the sheet metal holder.

Therefore, the sheet metal holder is not directly received on the cylinder plate with the operating cylinders providing support for the sheet metal holder. Instead the perforated plate is provided with through-extending bores for receiving spacer bolts. This plate is present between the sheet metal holder and the cylinder plate. In this embodiment, all of the bores or individually some of the through-extending bores of the perforated plate can be supplied with spacer bolts.

The spacer bolts can have a length equal to the thickness of the perforated plate. The diameter of the bolt is larger than the diameter of the auxiliary pistons of the operating cylinders. Within the marginal area of the bores receiving the auxiliary pistons of the operating cylinders, the spacer bolts will stand on the top side of the cylinder plate. This will result if the forces applied by the sheet metal holder to the spacer bolts is greater than the forces resulting from having hydraulic fluid pressing against the auxiliary pistons.

BRIEF DESCRIPTION OF THE DRAWINGS

Other objects and features of the present invention will become apparent from the following detailed description considered in connection with the accompanying drawing which discloses several embodiments of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 2:
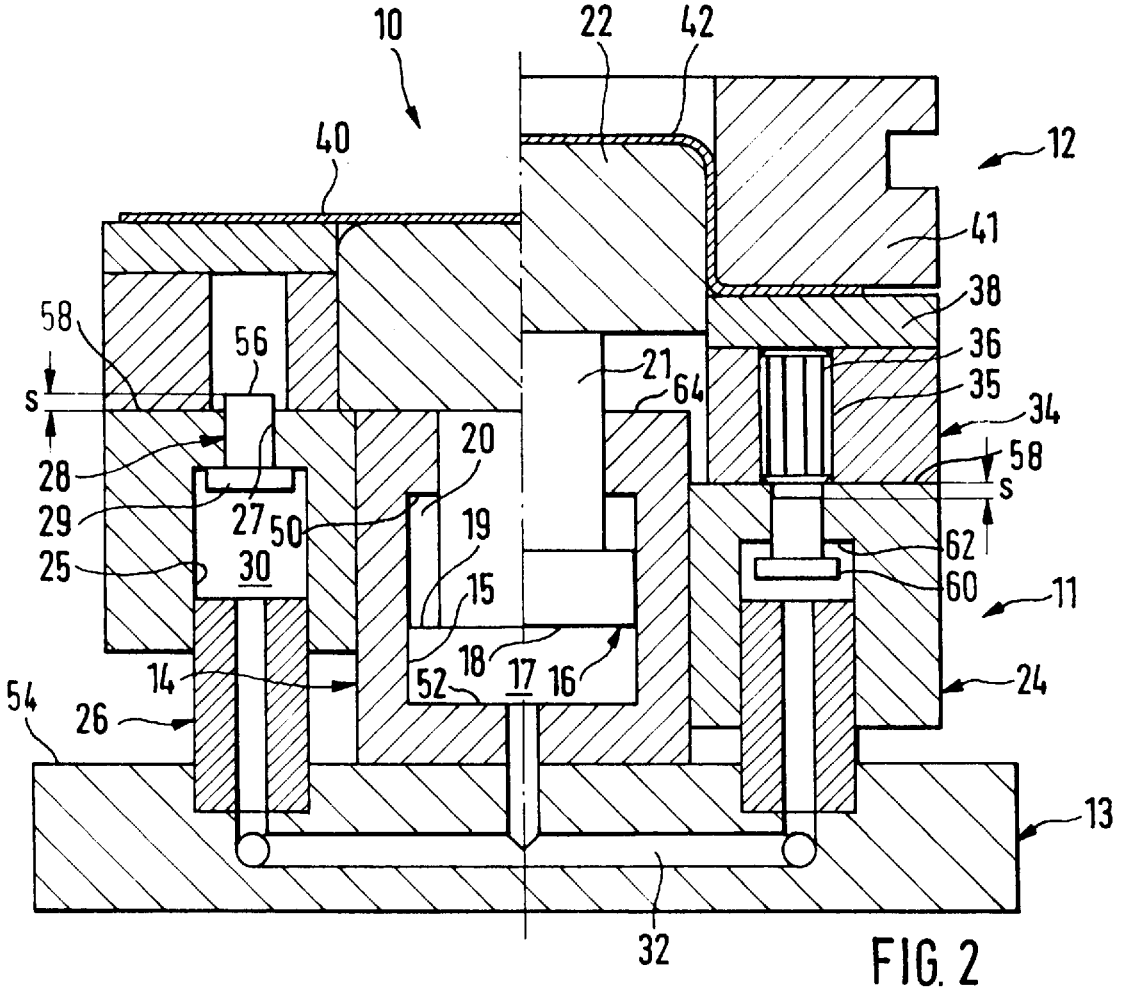
FIG. 2 shows two vertical sectional views of the drawing die illustrating two different operating conditions, according to section line 2—2 in FIG. 1.

Turning now in detail to the drawings, drawing die 10 shown in FIG. 2 comprises a bottom part 11 of the die, which is receivable on the table of a drawing press not shown. Also shown is a top part 12 of the die which is vertically movable in relation to the bottom part, with the top part of the die being received on a ram of the press not shown. This tool is a die which is useful for deep-drawing sinks manufactured from stainless steel.

Bottom part 11 of the die comprises a base plate 13, on which a centrally arranged cylinder block 14 is received. Cylinder block 14 has a second forming cylinder 15, in which a forming piston 16 is received and is guided with axial movability. Forming piston 16 is designed in the form of a stepped piston and has a pressure medium admission surface 18 closing off a rear side pressure admission chamber 17 of the forming cylinder. There is also a circularly shaped difference surface 19 disposed opposite the rear side pressure admission surface 18. The surface 19 is acted upon by hydraulic medium from a difference chamber 20. A piston rod 21 extends from the difference surface 19 of the forming piston 16 in the direction of the front side 50 facing away from the rear side 52 of the pressure admission chamber 17. There is a draw punch 22 received on the piston rod 21.

Furthermore, the die bottom part 11 comprises a cylinder plate 24 enclosing central cylinder block 14. This cylinder plate has a plurality of first hydraulically operating cylinders 25 positioned around cylinder block 14. Operating pistons 26 are received in the operating cylinders 25 and are rigidly joined with base plate 13, projecting from the base plate on the top side 54. On the sides facing away from the operating pistons 26, bores 27 extend through the cylinder plate 24 coaxially with the operating cylinders. There are auxiliary pistons 28 received within the bores 27. These auxiliary pistons 28 each have a piston head 29 received within the respective operating cylinder 25. In the fully extended condition, the piston head 29 abuts the bottom of the associated cylinder, thereby forming a stop limiting the auxiliary piston. The longitudinal length of pistons 28 is dimensioned in such a way that the ends 56 of the auxiliary pistons 28 facing away from base plate 13 project by a predetermined distance "s" beyond the cylinder plate 24 on the top side 58 of the plate 24. When the bottom side 60 of piston heads 29 rests against the ends 62 of operating cylinders 25 arranged in cylinder plate 24, the ends 62 are fully extended from the operating pistons 26. Pistons 26 are rigidly and solidly joined with base plate 13.

The rear-side pressure admission chamber 17 of the central forming second cylinder 15 and the pressure admission chambers 30 of the first operating cylinders 25 are positioned around the cylinder block 14. They are communicatively connected by conduits or ducts 32 extending through the operating pistons 26 of the operating cylinders 25 and through the base plate 13.

A perforated plate 34 is received on the top side of the cylinder plate 24. Perforated plate 34 is provided with through-extending bores 35, which are aligned with operating cylinders 25 and auxiliary pistons 28. Axially displaceable spacer bolts 36 are received in the through-extending bores 35; and the length of said bolts is equal to the thickness of the perforated plate 34. A sheet metal holder plate 38 is received on perforated plate 34, through which plate 34 the spacer bolts 36 extend in the through-extending bores 35.

The left-hand sectional half-view of FIG. 2 shows the drawing die 10 at the start of a drawing operation. Forming piston 16 is guided with axial displaceability within the forming cylinder 15 and is in its lower position. Piston rod 21 is at this time aligned level with the top edge 64 of cylinder block 14 which receives the forming cylinder 15. Draw punch 22, which is received on the piston rod 21 of the forming piston 16, is at this time in its lowermost position. Draw punch 22 is aligned level with the sheet metal holder 38. It is also possible for punch 22 to be below the holder 38 to such an extent that before the drawing operation starts, pressure sufficient for holding or retaining the sheet metal is built up in operating cylinders 25. This is due to the then-possible idle movement of the sheet metal holder 38.

In the left-hand sectional half-view of FIG. 2, which shows the start of a drawing operation, the cylinder plate 24 is in its elevated position, which is substantially level with the top edge 64 of the centrally arranged cylinder block 14. There is pressure of the hydraulic fluid being applied during the drawing process within the operating cylinders 25. These cylinders provide support for the sheet metal holder 38. Due to this pressure, the auxiliary pistons 28 are acted upon by the hydraulic fluid and are made to project beyond the top side 58 of the cylinder plate 24 by the aforementioned distance "s". Accordingly, the spacer bolts 36 which are arranged coaxially with auxiliary pistons 28 are displaced within the through-extending bores 35 of the perforated plate 34. Plate 34 receives these spacer bolts in such a way that the sheet metal holder 38 is received on the spacer bolts 36 which are projecting beyond the perforated plate 34 on the top side of the plate. Thus, bolts 36 partly support holder 38.

In the left sectional half-view of FIG. 2, a sheet metal plate 40 rests on sheet metal holder 38 and thus rests on the draw punch 22, which is approximately level with the sheet metal holder. When the top die part 12 is lowered because of contact with a draw ring 41, ring 41 pushes downwardly on the plate 40 within the range of movement of sheet metal holder 38. This first leads to chucking or clamping of the plate 40 between the draw ring 41 and the sheet metal holder 38. Then, as the draw ring 41 is driven down further for drawing a hollow part 42, there is hydraulic fluid received within the pressure admission chambers 30 of the operating cylinders 25. Cylinders 25 serve to provide support for the sheet metal holder. Thus, the hydraulic fluid is displaced simultaneously, and flows into the rear side pressure admission chamber 17 of the surface 18 of the forming piston 16. The forming piston 16 and the draw punch 22 received on the piston rod 21 consequently upwardly advance opposite to the downward movement of the sheet metal holder 38 as the holder 38 is being lowered. The drawing operation consequently takes place in the following sequence. A first part of the drawing is caused by the downward travel of the sheet metal holder 38; and a second part of the drawing is caused by the upward advancement of draw punch 22.

During the drawing, the sheet metal holder 38 which is partly received on spacer bolts 36 extending through perforated plate 34 is subjected to deformation depending on the drawing force acting on it. The drawing force acts in such a way that the sheet metal-retaining force occurring within the ranges where the sheet metal holder 38 is supported by spacer bolts 36 is partially higher than in adjacent zones. In fact, spacer bolts 36 are forced back from their positions projecting upwardly beyond perforated plate 34 under the pressure of the drawing force. However, due to the admission of pressure into the auxiliary pistons 28, on which the spacer bolts 36 are standing, these spacer bolts are subjected to a counter force. This counter force imparts and supplies the partial increase in the force retaining and holding the sheet metal. The operating position at the end of a drawing operation is shown by the right-hand sectional half-view of FIG. 2.

Figure 1:
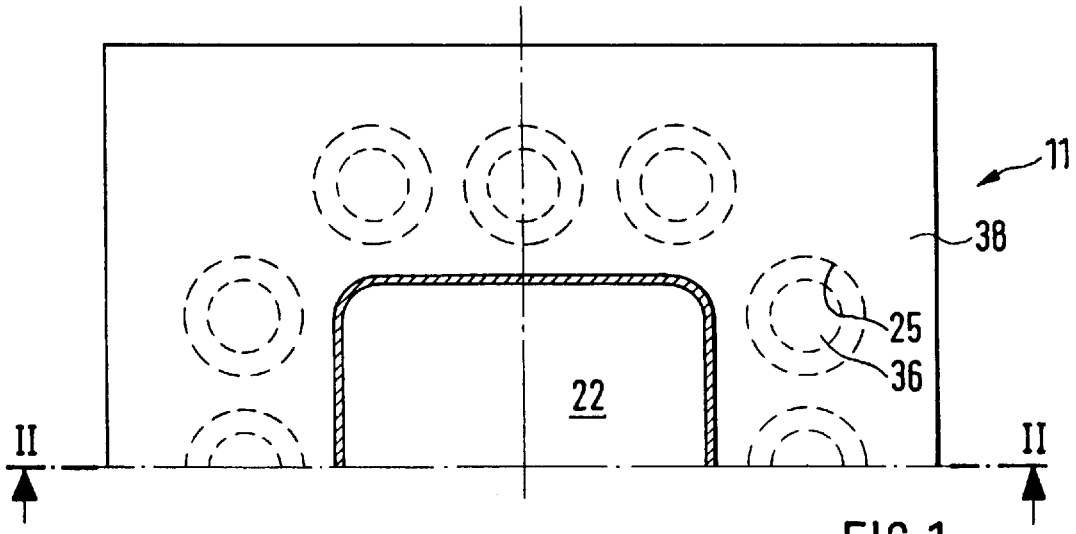
FIG. 1 shows a top view of half of the bottom part of the drawing die received on a press table.

When the drawing die 10 of the present invention is utilized, only some of the through-extending bores 35 of the perforated plate 34 received on cylinder plate 24 have to be fitted with spacer bolts 36. Those bores 35 fitted with bolts 36 are for supporting sheet metal holder 38 in areas which are critical for the drawing operation. That is only in the areas where undesirable formations of wrinkles or folds might occur or have to be eliminated. It is shown in FIG. 1 that the operating cylinders 25 serving for the support of the sheet metal holder 38 may be arranged around draw punch 22 in an approximately evenly distributed manner. In this way, partial adjustment of the force retaining the sheet metal is obtained that will adequately satisfy the requirements for each type of drawing operation. This is by equipping the perforated plate 34 with spacer bolts 36 only in those areas of the sheet metal holder 38 which are critical to prevent the formation of wrinkles.

While several embodiments of the present invention have been shown and described, it is to be understood that many changes and modifications may be made thereunto without departing from the spirit and scope of the invention as defined in the appended claims.

What is claimed is:

1. A die for drawing molded sheet metal parts, said die having a bottom part, a top part, and said bottom part and said top part being movably guided relative to each other comprising:

a drawing ring on the top part of the die, and a sheet metal holder received on at least one of a plurality of first hydraulically operating cylinders on the bottom part of the die;

a draw punch enclosed by the sheet metal holder;

a second hydraulically operating cylinder supporting said draw punch;

duct means for hydraulically connecting said at least one of the first hydraulically operating cylinders with said second hydraulically operated cylinder;

said draw punch acted upon by a hydraulic fluid displaced from the said at least one first hydraulically operating cylinder during a drawing operation;

said draw punch being actuated to move in a direction opposite to a direction of movement of the metal sheet holder, when said hydraulic fluid is displaced from said at least one first hydraulically operated cylinder through said duct means and into said second hydraulically operated cylinder;

selectively engageable spacer bolts (36); and auxiliary pistons (28) being acted upon by hydraulic fluid pressure built up in the first operating cylinders (25) such that said auxiliary pistons (28) partly support the sheet metal holder (38) by said selectively engageable spacer bolts (36), positioned between said auxiliary piston (28) and said holder (38).

2. A die for drawing molded sheet metal parts, said die having a bottom part, a top part, and said bottom part and said top part being movably guided relative to each other comprising:

a drawing ring on the top part of the die, and a sheet metal holder received on at least one of a plurality of first hydraulically operating cylinders on the bottom part of the die;

a draw punch enclosed by the sheet metal holder;

a second hydraulically operating cylinder supporting said draw punch;

duct means for hydraulically connecting said at least one of the first hydraulically operating cylinders with said second hydraulically operated cylinder;

said draw punch acted upon by a hydraulic fluid displaced from the said at least one first hydraulically operating cylinder during a drawing operation;

said draw punch being actuated to move in a direction opposite to a direction of movement of the metal sheet holder, when said hydraulic fluid is displaced from said at least one first hydraulically operated cylinder through said duct means and into said second hydraulically operated cylinder;

a cylinder plate (24) for containing the first operating cylinders (25) for receiving said sheet metal holder (38); and operating pistons (26) guided in said first operating cylinders (25) projecting from a die base plate (13) into the first operating cylinders (25); and at least some of said first operating cylinders (25) have auxiliary pistons (28) for partly supporting the sheet metal holder (38), said auxiliary pistons being received in bores of the first operating cylinders (25) and being acted upon by hydraulic fluid from the pressure admission chambers (30) of the first operating cylinders (25).

3. The drawing die according to claim 2, wherein said auxiliary pistons (28) each have an end for partly supporting the sheet metal holder beyond the cylinder plate (24).

4. The drawing die according to claim 3, further comprising a perforated plate (34) having through-extending bores (35) arranged coaxially with the auxiliary pistons (28) and acted upon by hydraulic fluid from the pressure admission chambers (30) of said first operating cylinders (25);

said perforated plate being received on the cylinder plate (24) containing the first operating cylinders (25); and spacer bolts (36) being removable pressure pieces and are guided in at least some of said through-extending bores (35), said spacer bolts being disposed upright on the auxiliary pistons (28), and projecting beyond the cylinder plate (24) and supporting parts of the sheet metal holder (38).

5. The drawing die according to claim 4, comprising said spacer bolts (36) having a length equal to a thickness of the perforated plate (34) and a diameter larger than a diameter of the auxiliary pistons (28) of the first operating cylinders (25).

* * * * *